United States Patent [19]

Kränzle et al.

[11] Patent Number: 4,636,146

[45] Date of Patent: Jan. 13, 1987

[54] AXIAL PLUNGER PUMP

[76] Inventors: Josef Kränzle, Rudolf-Diesel-Strasse 20, D-7918 Illertissen; Lutz Droitsch, Bussardweg 25, 4800 Bielefeld 12; Manfred Bauer, Am Märtelbrunnen 15, D-7918 Illertissen, all of Fed. Rep. of Germany

[21] Appl. No.: 741,319

[22] Filed: Jun. 4, 1985

[51] Int. Cl.[4] ..... F04B 1/12; F04B 27/03

[52] U.S. Cl. ..... 417/270

[58] Field of Search ..... 417/269, 270

[56] References Cited

U.S. PATENT DOCUMENTS

| | | | |
|---|---|---|---|
| 2,095,316 | 10/1937 | Davis, Jr. | 417/269 |
| 2,123,815 | 7/1938 | Tweddell | 417/270 |
| 2,188,035 | 1/1940 | Daoster | 417/269 |
| 2,392,279 | 1/1946 | Woods | 417/269 |
| 3,018,737 | 1/1962 | Cook et al. | 417/269 |
| 3,180,277 | 4/1965 | Thresher | 417/269 |
| 3,292,554 | 12/1966 | Hessler | 417/269 |
| 3,373,695 | 3/1968 | Yohpe | 417/454 |
| 3,661,480 | 5/1972 | Forschner | 418/179 |
| 3,811,798 | 5/1974 | Buckford | 417/269 |
| 4,105,369 | 8/1978 | McClocklin | 417/269 |
| 4,195,970 | 4/1980 | Zalis | 417/454 |
| 4,396,357 | 8/1983 | Hartley | 417/269 |
| 4,507,058 | 3/1985 | Schoenmeyr | 417/270 |

FOREIGN PATENT DOCUMENTS

| | | | |
|---|---|---|---|
| 1224096 | 1/1960 | France | 417/270 |

*Primary Examiner*—Louis J. Casaregola

*Attorney, Agent, or Firm*—Armstrong, Nikaido, Marmelstein & Kubovcik

[57] ABSTRACT

An axial plunger pump for high pressure purposes using three plungers in a star like arrangement around an axis of a wobble plate. Each plunger has associated therewith a pumping unit and all pumping units are located in a common pumping unit block and each of the pumping units comprising a pump chamber having inlet and outlet valves connected to a common inlet duct and outlet duct respectively. Plunger cylinders of at least one of the plungers are connected to pump chamber at a position between the inlet valve and the outlet valve while the plunger cylinder of at least another plunger is connected to the associated pump chamber at a position below the inlet valve.

4 Claims, 8 Drawing Figures

AXIAL PLUNGER PUMP

FIELD OF THE INVENTION

The invention relates to an axial plunger pump for feeding liquids at high pressure. Pumps of this type are used in connection with washing systems for cleaning of vehicles and machine parts and the like. The pumps are also ideally suited for pesticides.

BACKGROUND OF THE INVENTION

There have become known axial plunger pumps using a wobble plate urging three plungers in a reciprocing manner alternately into pump chambers. The plungers are arranged angularly and radially at equal distances around the axis of the wobble plate. Two of the plungers are in a horizontal plane above the axis of the wobble plate whilst the other is arranged below that axis.

In view of this arrangement problems arise in connecting the pump chambers to an inlet duct and an outlet duct and in simply arranging the inlet valves and outlet valves for the three pump chambers.

SUMMARY OF THE INVENTION

In consideration of the above it is an object of the present invention to provide an axial plunger pump having a simplified design.

It is an other object of the present invention to provide an axial plunger pump offering simple connections of the inlet duct and the outlet duct to the pump chambers.

Still another object of the present invention is to provide an axial plunger pump of uniform design for those portions associated with each plunger.

These and other objects are achieved by an axial plunger pump comprising:

(a) a wobble plate rotatable around an axis thereof;

(b) a plurality of plungers having longitudinal axes arranged radially and angularly at equal distances around that axes of said wobble plate and engaging a face surface of said wobble plate;

(c) a pumping unit block containing a plurality of pumping units, one for each plunger;

(d) inlet and outlet valves provided for a pump chamber for each of said pumping units all of said inlet valves being arranged in one plane and being connected to a common inlet duct and all of said outlet valves being arranged in one plane and being connected to a common outlet duct;

(e) a plurality of cylinders, one for each of said plungers for reciprocing movement of those ends of said plungers distant from said wobble plate therein, at least one of said cylinders being connected to one of said pump chambers between its inlet and outlet valves whilst at least one of said cylinders being connected to the associated pump chamber at a position located below the inlet valve.

With such an arrangement the pumping unit block may be manufactured by only few processing steps, in particular machining steps. All elements used for each pumping unit are similar for each unit.

DESCRIPTION OF A PREFERRED EMBODIMENT

Figure 1:
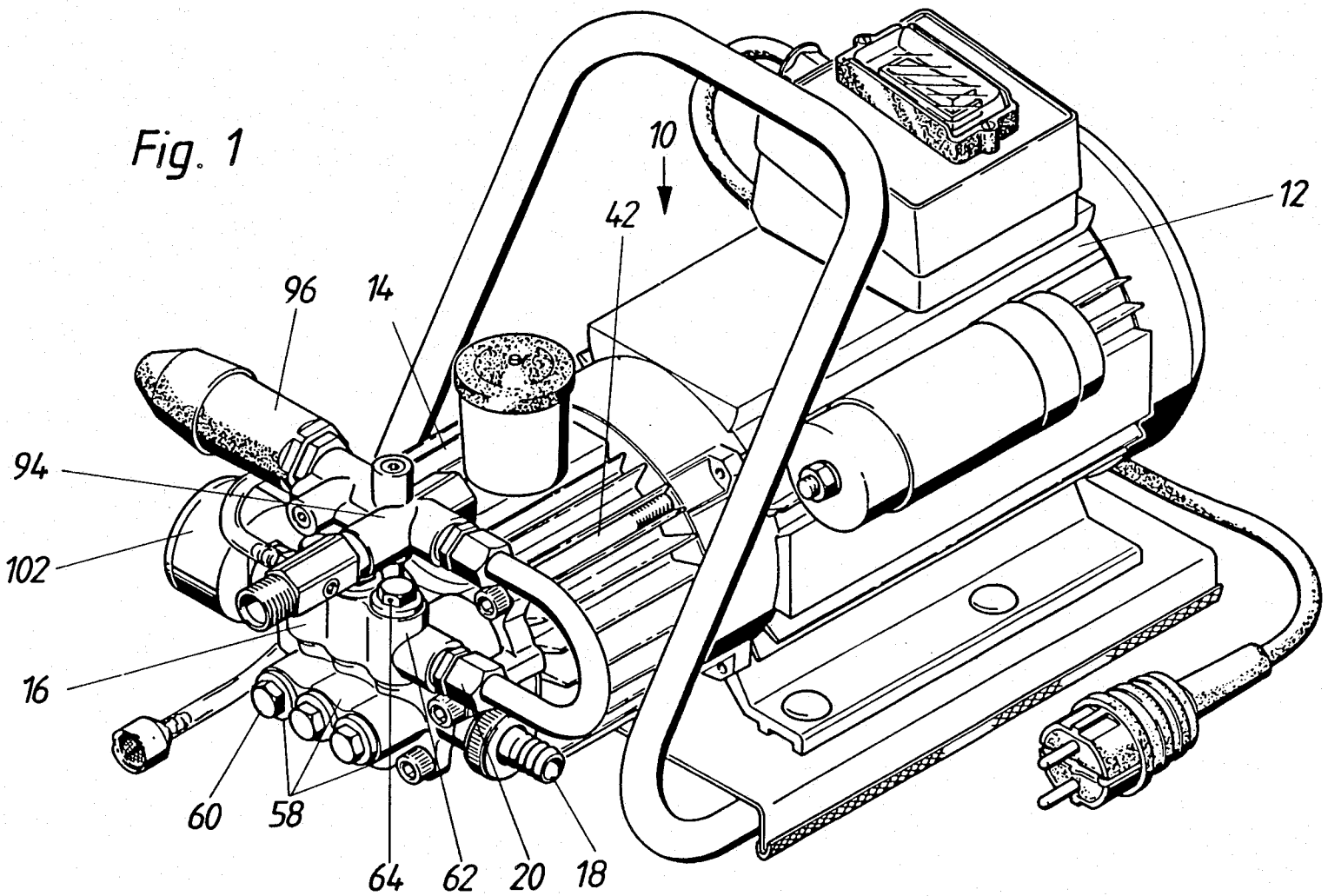
FIG. 1 is an overall perspective view of an axial plunger pump according to the invention.
Figure 3:
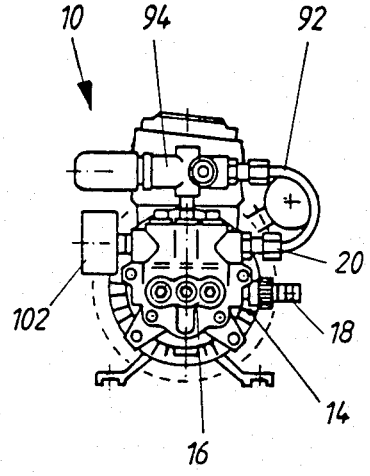

FIGS. 1 and 3 show an overall view of an axial plunger pump 10 according to a preferred embodiment for high pressure use having attached thereto an electric motor 12 for rotation of a wobble plate 30 (FIG. 4) being arranged in a pump housing 14. Attached to the pump housing 14 is a pumping unit block 16 having an inlet port 18 and an outlet port 20.

Figure 4:
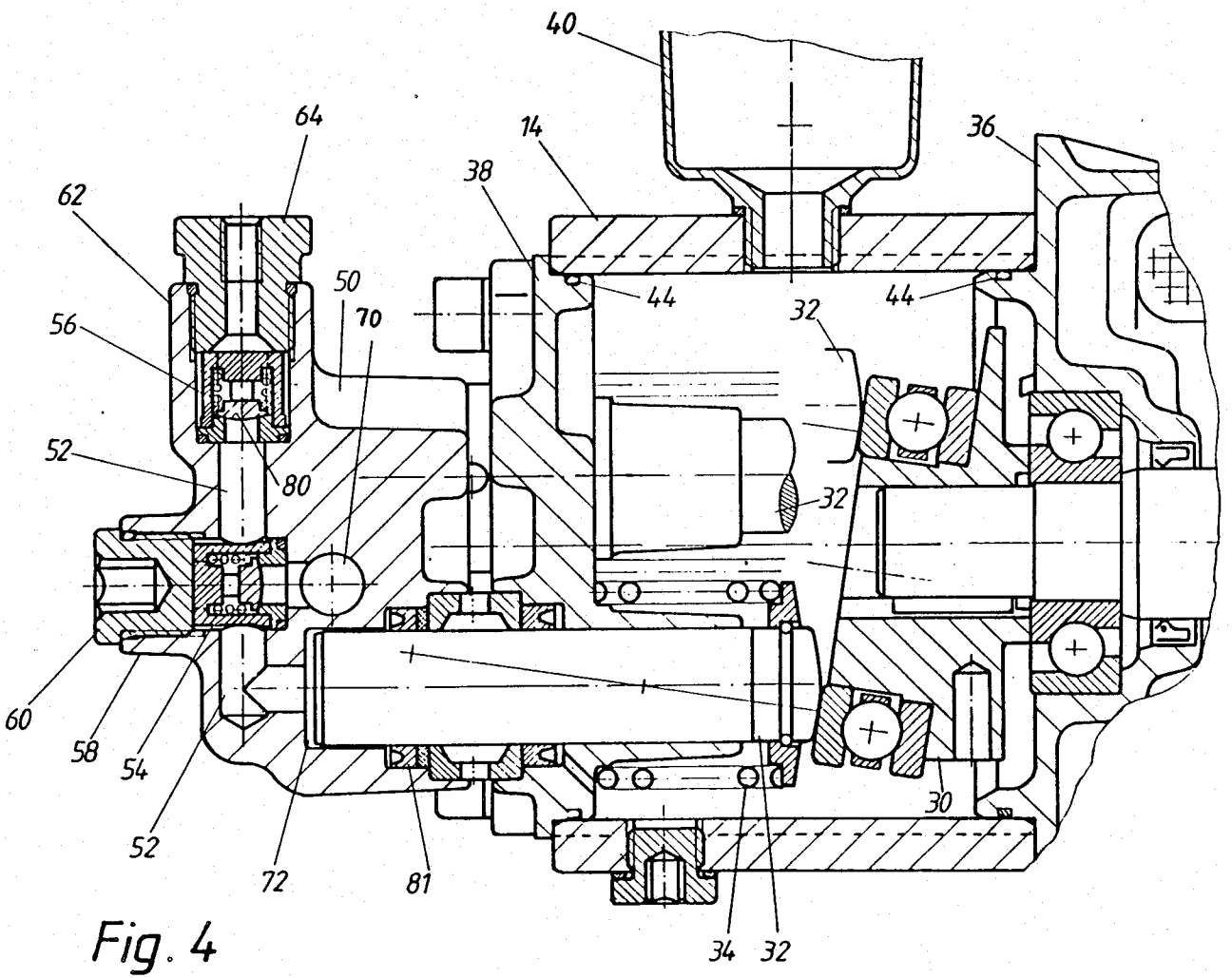
FIG. 4 is a vertical sectional side view of the pump of FIG. 1, FIGS. 5 and 6 are vertical sectional views of a pumping unit for a lower plunger and an upper plunger respectively.

As best seen from FIG. 4 in the pump housing 14 three plungers 32 are arranged with their longitudinal axes at equal distance around an axis of the wobble plate 30 and an equal angular distance of 120°. Whilst two plungers are arranged in a horizontal plane above the axis of the wobble plate 30 one plunger 32 is located below that axis.

The end faces of all three plungers 32 engange the face surface of the wobble plate 30 and are urged alternatingly to the left by the rotating wobble plate 30 against the pressure of compression springs 34 supporting to the inner face surface of a housing plate 38.

According to one aspect of the present invention housing 14 is formed by extruded material preferably aluminium having arranged longitudinal ribs thereon. Such a design offers the advantage that housings 14 may be cut at any desired lengths which is much cheaper than a housing moulded from aluminium or other metal. The housing 14 is closed at its opposite faces by a motor plate 36 and the housing plate 38, respectively. The plates 36 and 38 are tightly fixed to the end faces of the housing 14 by screws 42 (FIG. 1) sealing rings 44 being provided between the inner peripheral surface of the housing 14 and cylindrical surfaces of the plates 36 and 38. Alternatively sealings (not shown) may be provided between the end faces of the housing 14 and the plates 36 and 38. A container 40 is placed on top of the housing 14 for supplying oil to the interior of the housing which oil serves as a lubrication for all moving parts contained therein.

The pumping unit block 16 (FIG. 1) comprises a block 50 (FIG. 4) made of metal preferably brass containing a pumping unit each for each plunger 32. FIG. 4 shows the specific design of the pumping unit for a plunger 32 arranged below the axis of the wobble plate 30. Each pumping unit includes a pumping chamber 52 formed as a vertical bore and connected, via an inlet valve 54 to a common inlet duct 70 formed as a simple horizontal bore in the block 50 located between the upper and lower plungers 32. The inlet valves 54 of all pumping units are aligned to each other in respect to a horizontal axis parallel to the inlet duct 70. The inlet valves 54 are inserted via a threaded sleeve 58 which may be closed by a threaded closure member 60 (see also FIG. 1).

Figure 2:
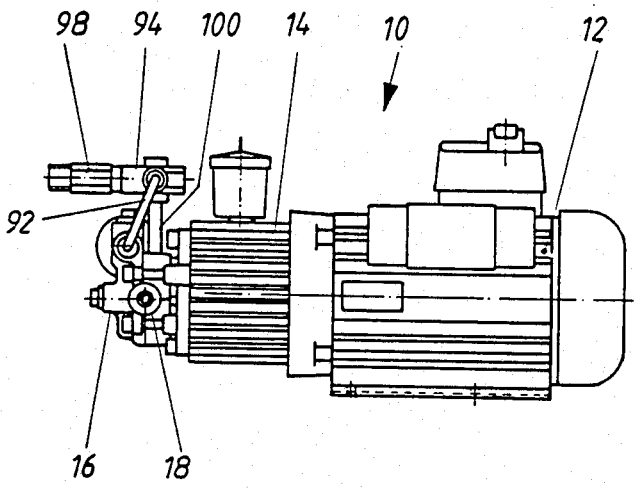
FIGS. 2 and 3 are side views perpendicular to each other of the axial plunger pump according to FIG. 1.

Whilst the longitudinal axes of the inlet valves 54 are directed horizontally the axes of outlet valves 56 are directed vertically which outlet valves are located at the upper end of the pump chambers 52. The outlet valves 56 may be inserted through a threaded sleeve 62 which is closed by a closure member 64. A common outlet duct is formed in the space above closure elements 80 of all outlet valves 56 which outlet duct ends at the outlet port 20 (FIG. 1 to 3).

It should be noted that such a design of the pumping unit block 16 is extremely simple and uniform for all three pumping units and offers a simple provision of the inlet and outlet ducts as well as of the inlet and outlet valves. All valves may be of similar construction.

Figure 5:
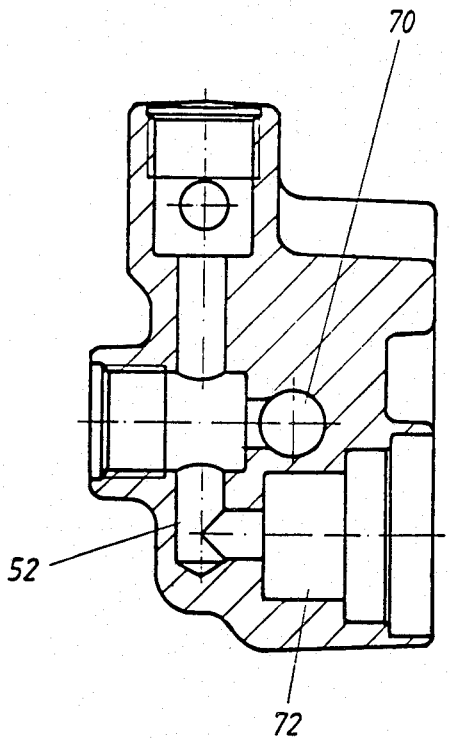
Figure 6:
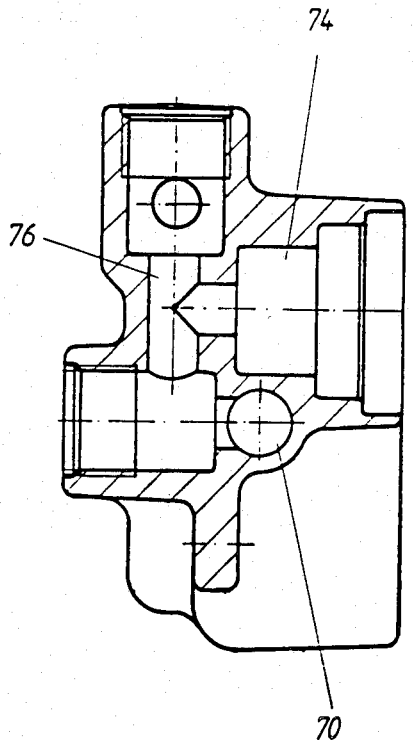

It is now referred in particular to FIGS. 4 to 6 which show the different connection of plunger cylinders 72 to the pump chamber 52 for the upper and lower plungers 32. According to a main aspect of the present invention the plunger cylinder 72 of the lower plunger is connected to its associated pump chamber 52 at a position which is located below its associated inlet valve 54. This is in particular shown in FIGS. 4 and 5. This is in contrast to the conventional connection of a plunger cylinder 74 to a region 76 of the associated pump chamber which region is located between the inlet valve 54 and the outlet valve 56 (FIG. 6).

It should be noted that with three plungers 32 two of them are in a horizontal plane which may be located below the axis of the wobble plate 30 which means that for these two plungers the design according to FIG. 5 applies. The third plunger would then be located above the axis of the wobble plate 30 and would then be connected to the pump chamber in a design according to FIG. 6. Alternatively and preferably two of the plungers are arranged above the axis of the wobble plate 30 with a design of their associated pumping units according to FIG. 6. It should further be noted that, if desired, four plungers with associated pumping units could be provided with a pair of plungers each in horizontal planes located above and below the axis of the wobble plate 30, respectively.

Thus, with a design according to the invention a simple and uniform design of the pumping unit block as achieved despite of the angularly offset arrangement of the plungers 32.

With the design of the axial plunger pump according to FIG. 4 the plunger cylinder 72 is sealed by a sealing 81. For pumps operating at very high pressures it may be useful to provide a means preventing leakage of liquid out of the plunger cylinders 72 into the housing 14 or into the atmosphere.

Figure 8:
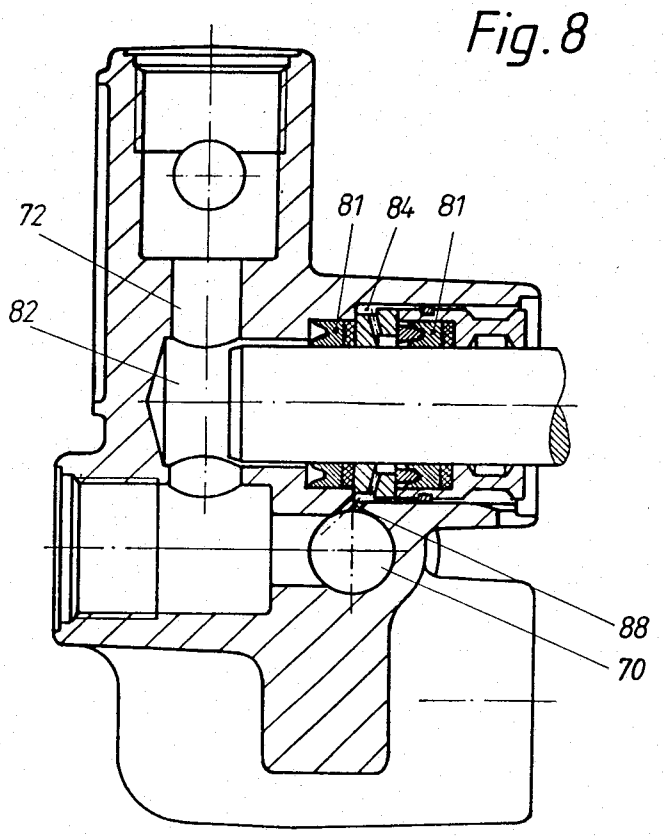
FIG. 7 and 8 are vertical sectional views similar to those of FIGS. 5 and 6 of pumping units in a modified design.
Figure 7:
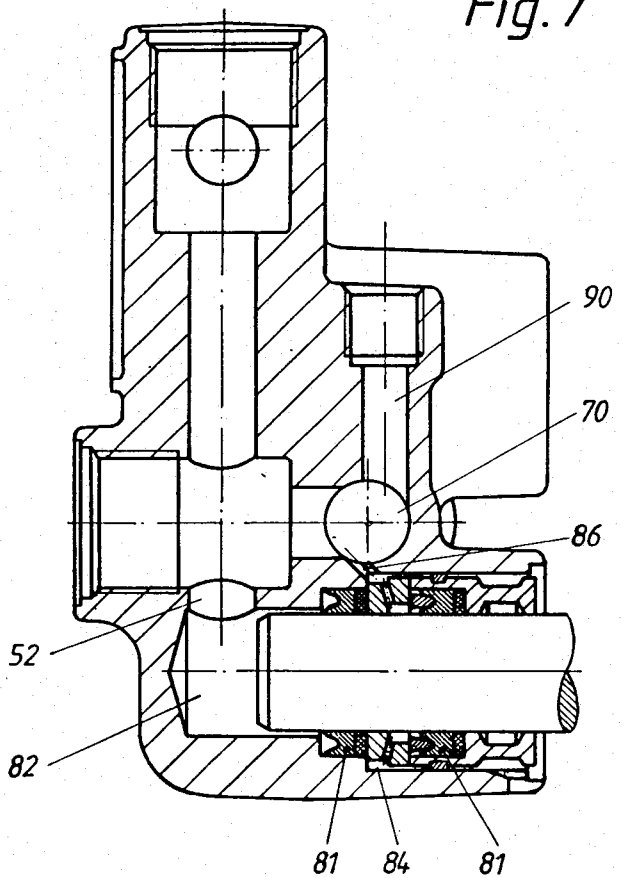

FIGS. 7 and 8 show a very simple manner for removing leaking liquid from a space 84 which liquid may have leaked out from plunger cylinders 82 despite of sealing 81. FIG. 7 shows the arrangement for the pumping unit of the lower plunger and FIG. 8 shows the arrangement for an upper plunger. It should be noted that as a modification of the embodiment of FIGS. 4 to 6 the plunger cylinders 82 extend into the pump chambers 52 and 72 respectively. Behind the sealing 81 sealing the plunger cylinder 82 there is provided the leakage space 84 confined to the right in FIG. 7 and 8 by another sealing 81'. The leakage space 84 is arranged adjacent to the inlet duct 70. Thus, the only means necessary for removing leakage liquid from leakage space 84 is a short throughhole 86 and 88, respectively, between the leakage space and the inlet duct 70 with the result that no liquid pressure will build up in the leakage space.

The design of the pumping units according to FIGS. 7 and 8 shows a further feature of the invention. The position of the inlet duct 70 enables a simple connection of any desired device to the inlet duct 70. In particular, a pressure controlled bypass may be connected to duct 90 preferably consisting of a simple bore in the block 50 (FIG. 4). As may be seen particularly in FIGS. 1 to 3 the outlet duct passing laterally through the outlet valves 56 ends at the port 20 is connected via a bypass lead 92 to one input of a distributor 94 (see in particular FIG. 1). An overpressure unit 96 is connected to a further input of the distributor 94. An output part 98 likewise connected to the distributor 94 is exemplary connected to an output lead provided with a closure member (not shown). Upon closing the closure member pressure increases at the outlet duct of the pump causing the overpressure unit 94 to be activated and to recirculate the liquid flowing out of the distributor 94, via a bypass lead 100 (FIG. 2) and the duct 90 back into the inlet duct 70. Thus, the pump is not overloaded and liquid recirculates until the pressure in the output lead decreases below a predetermined value.

It should be mentioned that a manometer 102 may be connected to that end of the common outlet duct opposite to the outlet port 20 (FIG. 1 and 3).

It has been shown that the specific design of the pumping unit block 16 according to the invention and in particular the specific connection of the lower plunger cylinder to the associated pump chamber at a position below the inlet valve the design and manufacture of the pumping unit block may be considerably simplified. Block 50 may be manufactured by only a few process steps which mostly are drilling steps. Furthermore, liquid leaked out of the plunger cylinders may be easily removed. The arrangement as further simplyfied by using a housing 14 made of extruded aluminium.

We claim:

1. An axial plunger pump comprising (a) a wobble plate rotatable around an axis thereof;

(b) a plurality of plungers having longitudinal axes arranged radially and angularly at equal distances around that axis of said wobble plate and engaging a face surface of said wobble plate;

(c) a pumping unit block containing a plurality of pumping units, one for each plunger;

(d) a plurality of pump chambers, one for each pumping unit in the form of a bore, each extending in said pumping unit block in parallel to each other and perpendicular to a longitudinal axis of each plunger;

(e) inlet and outlet valves correspondingly connected at spaced locations to each of said pump chambers for each of said pumping units, all of said inlet valves being arranged in line and being connected to a common straight inlet duct and all of said outlet valves being arranged in line and being connected to a common straight outlet duct;

(f) a plurality of cylinders, one for each of said plungers for reciprocating movement of those ends of said plungers distant from said wobble plate therein, at least one of said cylinders being connected to its associated pump chamber between its inlet and outlet valves;

(g) said inlet duct passing between said plunger cylinders with part of said cylinders arranged above and below respectively of said axis of said wobble plate.

2. An axial plunger pump comprising (a) a wobble plate rotatable around an axis thereof;

(b) a plurality of plungers having longitudinal axes arranged radially and angularly at equal distances around that axis of said wobble plate and engaging a face surface of said wobble plate;

(c) a pumping unit block containing a plurality of pumping units, one for each plunger;

(d) a plurality of pump chambers, one for each pumping unit in the form of a bore, each extending in said pumping unit block in parallel to each other and perpendicular to a longitudinal axis of each plunger;

(e) inlet and outlet valves correspondingly connected at spaced locations to each of said pump chambers for each of said pumping units, all of said inlet valves being arranged in line and being connected to a common straight inlet duct and all of said outlet valves being arranged in line and being connected to a common straight outlet duct;

(f) a plurality of cylinders, one for each of said plungers for reciprocating movement of those ends of said plungers distant from said wobble plate therein, at least one of said cylinders being connected to its associated pump chamber between its inlet and outlet valves;

(g) said plunger cylinders being sealed against said plungers by a sealing means following by a leakage space being connected to said inlet duct by a through hole.

3. An axial plunger pump comprising (a) a wobble plate rotatable around an axis thereof;

(b) a plurality of plungers having longitudinal axes arranged radially and angularly at equal distances around that axis of said wobble plate and engaging a face surface of said wobble plate;

(c) a pumping unit block containing a plurality of pumping units, one for each plunger;

(d) a plurality of pump chambers, one for each pumping unit in the form of a bore, each extending in said pumping unit block in parallel to each other and perpendicular to a longitudinal axis of each plunger;

(e) inlet and outlet valves correspondingly connected at spaced locations to each of said pump chambers for each of said pumping units, all of said inlet valves being arranged in line and being connected to a common straight inlet duct and all of said outlet valves being arranged in line and being connected to a common straight outlet duct;

(f) a plurality of cylinders, one for each of said plungers for reciprocating movement of those ends of said plungers distant from said wobble plate therein, at least one of said cylinders being connected to its associated pump chamber between its inlet and outlet valves;

(g) said wobble plate and said plungers being contained in a housing having a cylindrical portion made of extruded material and wherein opposite end faces of said cylindrical part are in sealing engagement with cover plates one of which contains bearings for said plungers and having attached thereto said pump unit block whilst the other is an integral part of a drive for said wobble plate.

4. The pump of claim 3 wherein said cover plates are connected to each other by screws.

* * * * *